US005625172A

United States Patent [19]

Blichmann et al.

[11] Patent Number: 5,625,172

[45] Date of Patent: Apr. 29, 1997

[54] ENGINE ENCLOSURE AIR INLET/ DISCHARGE SOUND ATTENUATOR

[75] Inventors: John R. Blichmann, Lafayette, Ind.; Brian S. Johnson, New York, N.Y.

[73] Assignee: Caterpillar Inc., Peoria, Ill.

[21] Appl. No.: 424,676

[22] Filed: Apr. 18, 1995

[51] Int. Cl.[6] ..... E04F 17/04

[52] U.S. Cl. ..... 181/204; 181/224

[58] Field of Search ..... 181/200, 202, 181/204, 205, 224, 225

[56] References Cited

U.S. PATENT DOCUMENTS

| | | | |
|---|---|---|---|
| 3,434,565 | 3/1969 | Fischer . | |
| 3,762,489 | 10/1973 | Proksch et al. | 181/200 |
| 4,381,832 | 5/1983 | Rauch . | |
| 4,424,882 | 1/1984 | Moller . | |
| 4,765,437 | 8/1988 | Harwood et al. . | |
| 4,787,473 | 11/1988 | Fuchs et al. | 181/224 |
| 5,119,427 | 6/1992 | Hersh et al. . | |
| 5,162,621 | 11/1992 | Lee . | |
| 5,168,132 | 12/1992 | Beidl et al. . | |
| 5,173,576 | 12/1992 | Feuling . | |
| 5,183,976 | 2/1993 | Plemons, Jr. . | |
| 5,193,778 | 3/1993 | Unckrich . | |
| 5,268,541 | 12/1993 | Pettersson . | |
| 5,276,291 | 1/1994 | Norris . | |
| 5,304,749 | 4/1994 | Crandell . | |

*Primary Examiner*—Khanh Dang
*Attorney, Agent, or Firm*—Mark D. Becker

[57] ABSTRACT

A sound attenuator for an enclosure, in particular, an apparatus for attenuating the sound at the openings which allow air to enter and exit an internal combustion engine enclosure with minimal pressure loss. The attenuator comprises a combination of passive sound absorptive louvers place in series with a plurality of reactive Helmholtz resonator units mounted in parallel rows in the open area between each pair of louver. The Helmholtz resonators being tuned to attenuate a single or multiple low frequency noise spikes. The attenuator providing improved sound attenuation and requiring substantially less volume than a typically used absduct type silencer.

22 Claims, 4 Drawing Sheets

ENGINE ENCLOSURE AIR INLET/ DISCHARGE SOUND ATTENUATOR

TECHNICAL FIELD

The present invention relates generally to a silencer for an enclosure, and more particularly to an apparatus for attenuating the sound at the openings which allow air to enter and exit an engine enclosure.

BACKGROUND ART

Enclosures for internal combustion engines, such as those used in mobile power stations, are designed to minimize the sound levels outside the engine compartment. Typically this is accomplished by adding sound insulation to the wall of the enclosure. However, the engine enclosure must allow for sufficient inlet and exit airflow capacity to support combustion and to provide cooling air for the engine. Air inlets are provided by removing sections of the enclosure walls, thereby significantly increasing the sound levels outside the compartment.

It is known in the art to cover the enclosure air inlets and exits with sound dampening absorptive material, typically in the shape of straight or V-shaped louvers. However, engines emit sound based on firing pulses and other periodic occurrences such as cams, gears, and piston slap which generate considerable low frequency sound which, correspondingly have long wavelengths. Absorptive sound attenuators operate primarily at higher frequencies but are not effective at low frequencies. For example, to effectively attenuate 125 Hz sound using absorptive methods, such as a duct silencer or louver, would require approximately a 9 foot deep silencer. Due to limited space inside the engine enclosure, large commercially available duct-type silencer used to draw cooling and combustion air through the enclosure while attenuating noise through the opening are not practical.

A second problem with this type of silencer is that a trade-off must be made between the desired noise attenuation and the pressure drop across the panel. If the louvers are placed in close proximity, substantial broadband (mid- to high-frequency) noise reduction can be accomplished; however, close spacing increases the pressure loss across the panel and thereby reduces the air flow through the engine compartment.

Reactive silencers are common in engine exhaust mufflers and offer good broadband frequency performance. Unfortunately, this technology is highly restrictive to airflow and would also require a large unit for the volumes of air required to flow through it to provide both combustion and cooling air.

For sound attenuation at low frequencies, there are various principles, whose applications have been used and are used in sound attenuators, as is well known. One well known solution for sound attenuation at low frequencies is the Helmholtz resonator. The resonator consists of an air space which communicates with the "outer air" through an opening. An air plug present in the opening forms the mass that resonates on support of the spring force formed by the air enclosed in the hollow space. The resonant frequency of the Helmholtz resonator depends on the area of the opening, on the volume of the air space, and on the length of the air plug formed in the opening. When the volume of the air space becomes larger, the resonance frequency is shifted toward lower frequencies. When the area of the opening is made smaller, the resonance frequency is shifted towards lower frequencies.

When Helmholtz resonators are driven with acoustic energy at the resonant frequency, the resonators will absorb a maximum amount of the incoming acoustic energy. However, because they are tuned systems, the absorption decreases rapidly as the frequency of the incoming acoustic energy varies substantially from the resonant frequency. Thus, the principle limitation with these devices is that they attenuate sound energy efficiently only within a narrow frequency range centered at their tuned frequency.

The present invention is directed to overcome one or more of the problems as set forth above.

DISCLOSURE OF THE INVENTION

In one aspect of the present invention, an apparatus for attenuating sound from an enclosure is disclosed. The apparatus includes a frame, which is adaptable for mounting in a wall. The frame having inner and outer surfaces. The apparatus also includes a plurality of sound absorptive louvers positioned in the frame. The louvers are substantially parallel and spaced apart from one another. The louvers are arranged such that the louvers are substantially perpendicular to the flow direction of air in and out of said enclosure. Also included are a plurality of resonator boxes. Each box having a top, bottom, front, rear, and two side surfaces. Each of the resonator boxes having a opening in said bottom surface. A selected number of the resonator boxes are interconnected at the side surfaces to form a plurality of first resonator box rows. Each of the first resonator box rows extend across the frame and are spaced apart from one another and positioned between the louvers. The first resonator box rows are fixedly positioned at the rear surface to the frame inner surface such that the resonator box openings are arranged in a direction substantially perpendicular to the flow direction of air in and out of the enclosure.

In another aspect of the present invention, an apparatus for attenuating engine noise from a power system enclosure is disclosed. The apparatus includes an enclosure wall having inner and outer surfaces. The wall has an opening extending therethrough. The apparatus also includes a plurality of sound absorptive louvers positioned in the wall opening and being substantially parallel and spaced apart from one another. The louvers define a louver panel, the louver panel having an inner and an outer surface. Also included are a plurality of resonator boxes, each having a top, bottom, front, rear, and two side surfaces, and each having an opening in the bottom surface. A selected number of the resonator boxes are interconnected at the side surfaces to form a plurality of first resonator box rows. Each of the first resonator box rows extend across the wall opening and are positioned between the louvers which define an open area therebetween. The resonator box rows are fixedly positioned at the rear surface to the louver panel inner surface.

BEST MODE FOR CARRYING OUT THE INVENTION

Figure 1:
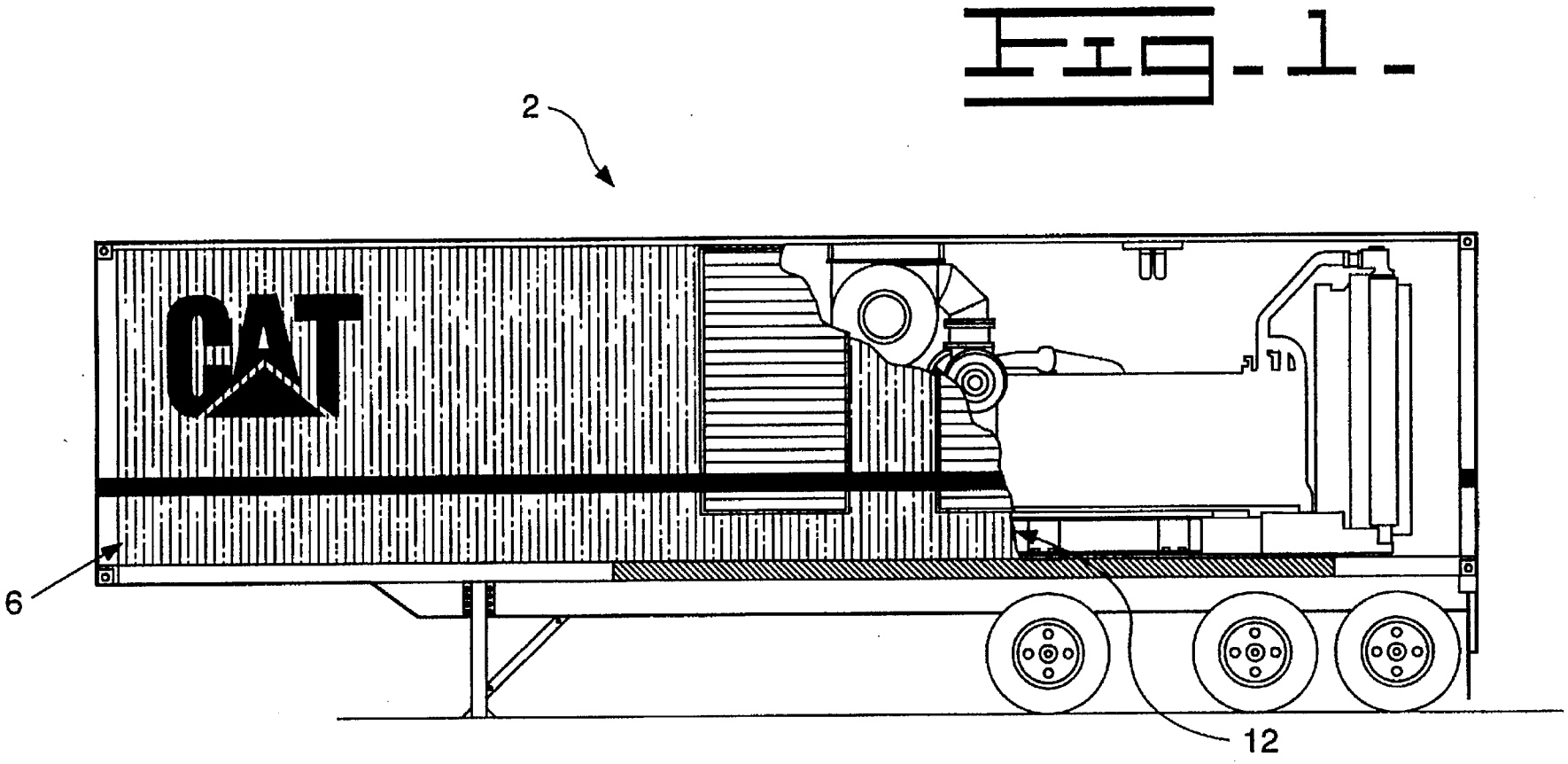
FIG. 1 is a side cutaway view of a mobile power system showing the orientation of the engine and the sound attenuation system installed in the wall of the power system enclosure according to one embodiment of the present invention.
Figure 2:
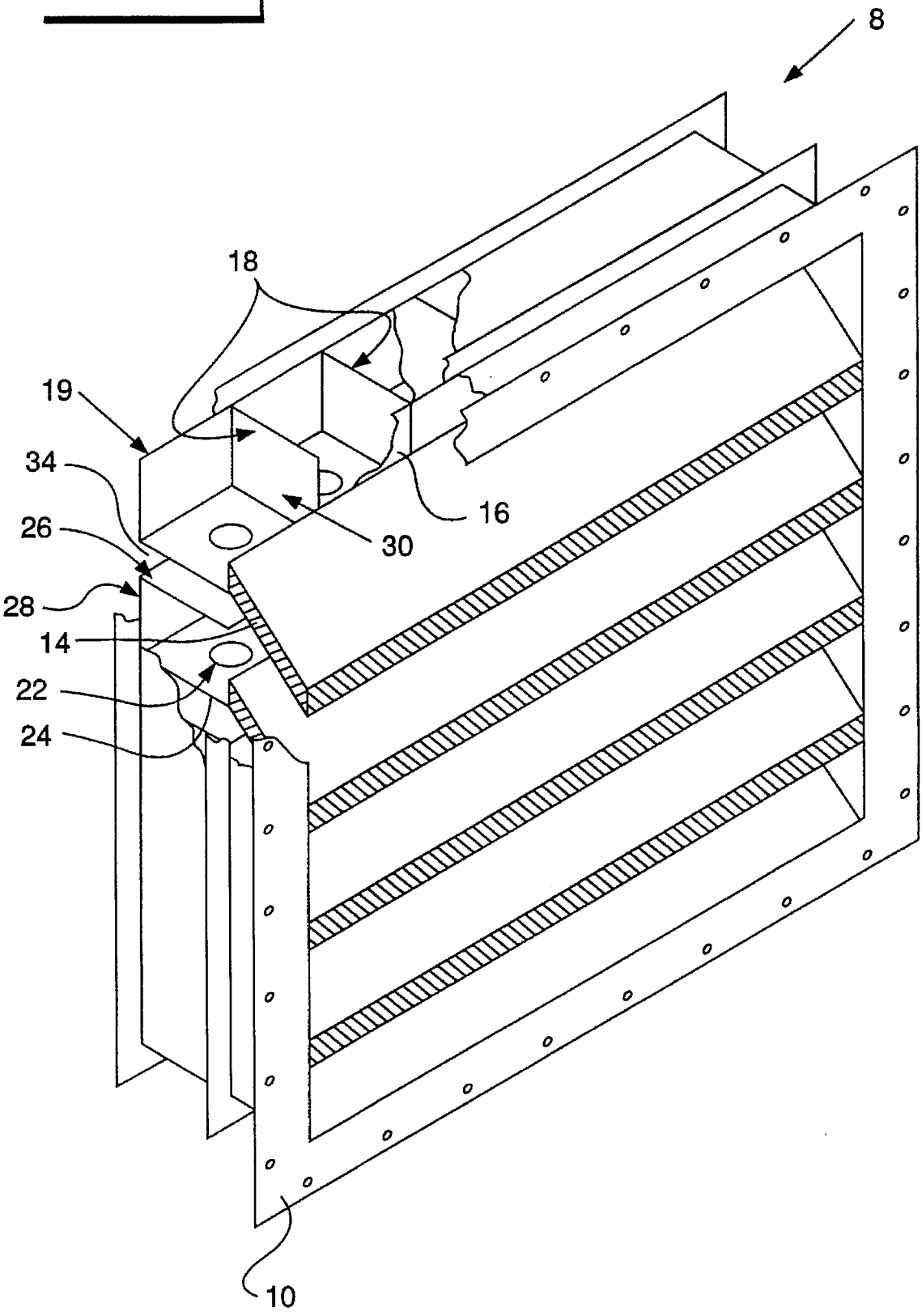
FIG. 2 is a side cross-sectional view of the sound attenuator of FIG. 1 with straight louvers.
Figure 3:
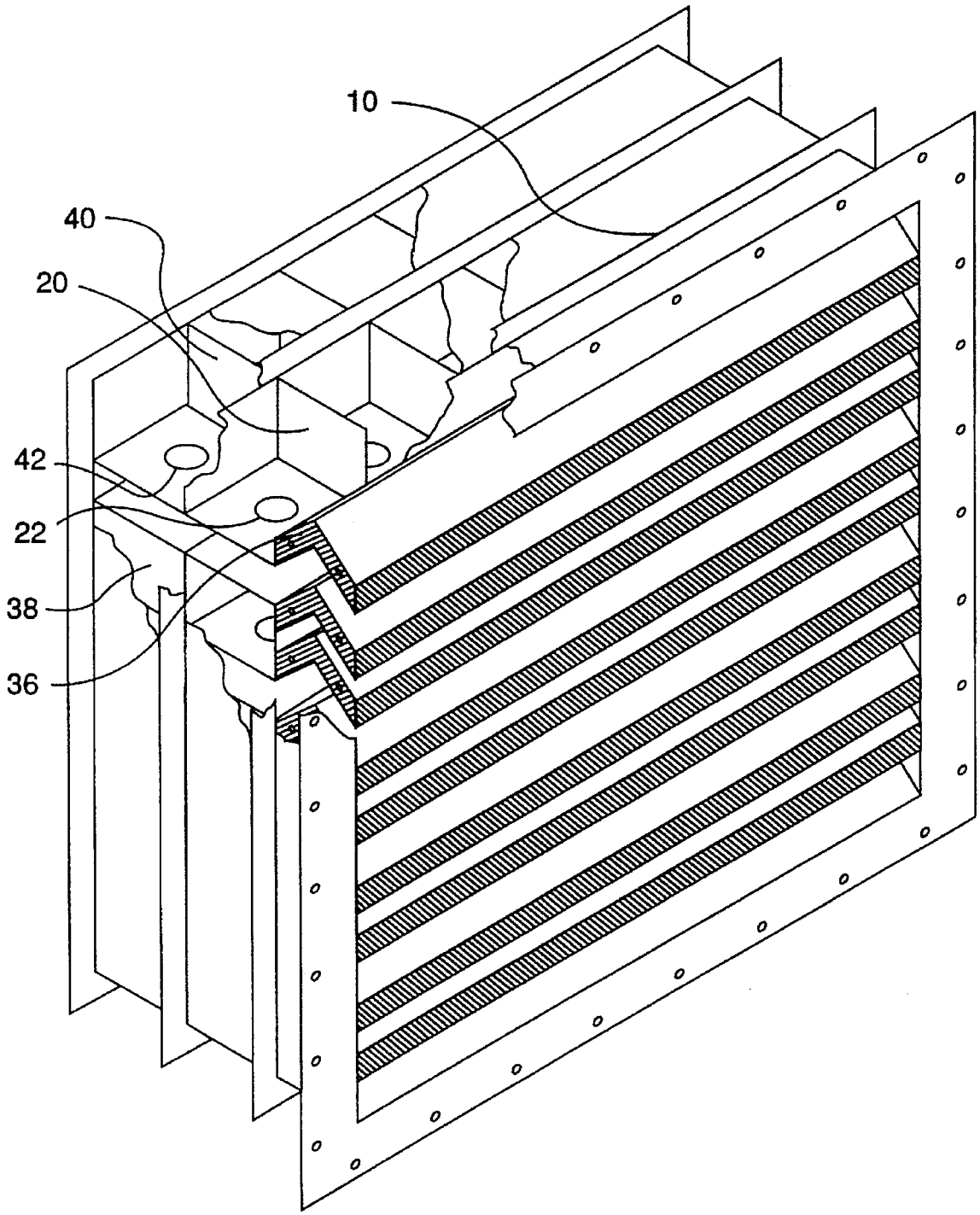
FIG. 3 is a side cross-sectional view of the sound attenuator of FIG. 1 with v-shaped louvers and a second row of resonator boxes.

Referring to FIGS. 1–3, wherein the same reference numerals designate the same elements or features throughout all of the FIGS. 1–3, a first embodiment of engine enclosure with an air inlet/discharge sound attenuation system is shown. While a particular design engine enclosure and power unit is illustrated in FIGS. 1–3 and described herein, it should be understood the present invention is also applicable to all engine enclosures.

FIG. 1 shows a mobile power station, 2, comprising an engine driven generator, fuel tank, electrical controls, cooling system, and exhaust system. The internal combustion engine, 4, is positioned within the power system enclosure, 6. Ambient air is required to enter the enclosure to provide combustion and cooling air for the engine, 4. Air enters the enclosure through the sound attenuator, 8, and the attenuator prevent sound from exiting the enclosure.

Referring to FIG. 2, the frame, 10, forms a flow duct when the sound attenuator, 8, is placed in its position in the enclosure wall, 12. During operation of the engine, cooling and combustion air are drawn through the sound attenuator, 8, and the cooling air exits through this opening after circulating through the engine compartment.

The sectional shape of the frame is rectangular in the direction perpendicular to the flow direction. As the material of the frame, 10, it is possible to use, e.g., aluminum, steel, or other rigid material Flanges are provided on the frame, 10, for mounting the frame to the enclosure wall, 12. A passive sound attenutation means is positioned within the frame, 10 to cover the opening. This passive attenuation means includes the use of a sound absorptive method such as a duct silencer, straight louvers, or V-shaped louvers. In one embodiment, straight sound absorptive louvers, 14, are positioned in the frame, 10, so that the absorptive material forms an angle to the enclosure wall, as shown in FIG. 2, and eliminates a line of sight through the louvers and into the enclosure and prevents the entrance of rain into the enclosure. The louvers 14, are positioned in the frame substantially parallel to one another and span the entire frame opening. The louvers, 14, are preferably acousti-glass with surface treatment facing mesh material. The mesh material is preferably 58% open minimum, 0.050" perforated or expanded metal. The louvers, 14, can be either a straight louver blade as shown in FIG. 2, a v-type louver as depicted in FIG. 3, or any other type of sound absorptive panel.

In another embodiment, the passive sound absorptive method could include the use of a duct silencer. The silencer is made of slats of sound absorptive material placed parallel to one another and spaced apart from one another to form a flow duct between each pair of slats. The slats have sound absorptive material on each side.

FIG. 2 shows a plurality of Helmholtz resonator units, 16, interconnected at their side surfaces, 18, to form a row or resonator member, 19. This embodiment utilizes six resonator units, 16 interconnected to span the frame. However, the number of resonator units, 16 can be varied depending on the size of the resonator units, the size of the enclosure opening, and the volume of air which must pass through the enclosure opening.

The resonator units, 16, are preferably constructed of aluminum, steel, or other rigid material. Each resonator unit consists of a closed volume 20, and an opening 22 communicating the internal closed volume 20 with the cooling and combustion air entering the enclosure. The resonator unit opening, 22, is positioned in one surface of the resonator unit substantially parallel to the direction of flow entering and exiting the enclosure. Although the opening could be placed in any surface of the resonator, the preferred location is on a surface which will preclude the collection of moisture and contaminants within the resonator. The diamter of the resonator opening and closed volume of each resonator unit is designed in accordance with a known formula to attenuate noise at and adjacent to a particular frequency. The characteristic length of the resonator unit must be less than one-eighth of the targeted wavelength. The tuned resonator frequency can be varied by changing the size of the resonator opening without modifiying the unit size.

The resonator members, 19, are supported on the frame 10 by their front and rear surfaces, 28 and 30, respectively. A plurality of resonator members, 19, are mounted to the frame 10 to form a resonator bank, 32. A resonator member, 19, is positioned between each pair of louvers, 14. The resonator members, 19 are spaced apart from one another to create an open area, 34 between the members which acts as a duct for the airflow entering the enclosure. The desired airflow through the attenuator is a function of the percent open area of the louvers and resonators. The embodiment shown in FIG. 2 is approximately 30% open for the desired airflow but can be larger or smaller depending on requirements of the installation. This construction allows for very low restriction to airflow which can be simulated by flow through a straight duct. The resonator members, 19 are positioned such that the open area between the members aligns with the open area between the individual louvers, 14. It is preferred to have the resonator members, 19, positioned such that the resonator bottom surface, 24, with the resonator opening, 22, aligned with the edge of the sound absorptive louvers, 14, in order to eliminate any line of sight through the louvers and resonator members. This results in the most effective attenuation of sound exiting the enclosure, 6.

FIG. 3 shows a second embodiment of the sound attenuator. In this embodiment the straight louvers are replaced with a v-shaped louver, 36. This design of louver results in greater sound attenuation of mid and high frequency sound due to the extra bend which is required to exit the enclosure. By adding this additional turn in the air before exiting, an additional quantity of sound energy can be absorbed by the absorptive material.

Due to the narrow frequency band which will be attenuated by a Helmholtz resonator, a plurality of these devices can be placed in series to eliminate multiple frequencies. FIG. 3 shows an embodiment which utilizes two resonator banks, 32, in series. The open area between the resonator members, 19, is maintained constant to create a duct and allow airflow to pass through the attenuator while minimizing the pressure loss. The second set of resonator units, 38, can have either the second resonator closed volume 40, or the second resonator opening, 42, sized to eliminate a second dominant noise frequency.

Industrial Applicability

Helmholtz resonators provide high attenuation over a very narrow frequency range. Fortunately, noise from internal combustion engines is comprised of several large spikes of low frequency noise, usually in multiples of the firing frequency, with one frequency spike being significantly higher than the others, as well as a lower volume of broadband noise. These low frequency spikes drive the overall sound level. Reducing the level of the highest spike will lower the overall sound level. In order to reduce the levels of the smaller spikes several resonators can be placed in series, each tuned (via hole size or volume) to cancel a specific frequency. The preferred embodiment has the resonators tuned to cancel the highest noise spike at a multiple of the engine firing frequency. To attenuate a balance of the engine broadband and higher frequency in nature, an absorptive louver is placed in series with the resonators. This allows the passive/reactive combination to be matched to the specific noise characteristic of the engine.

Figure 4:
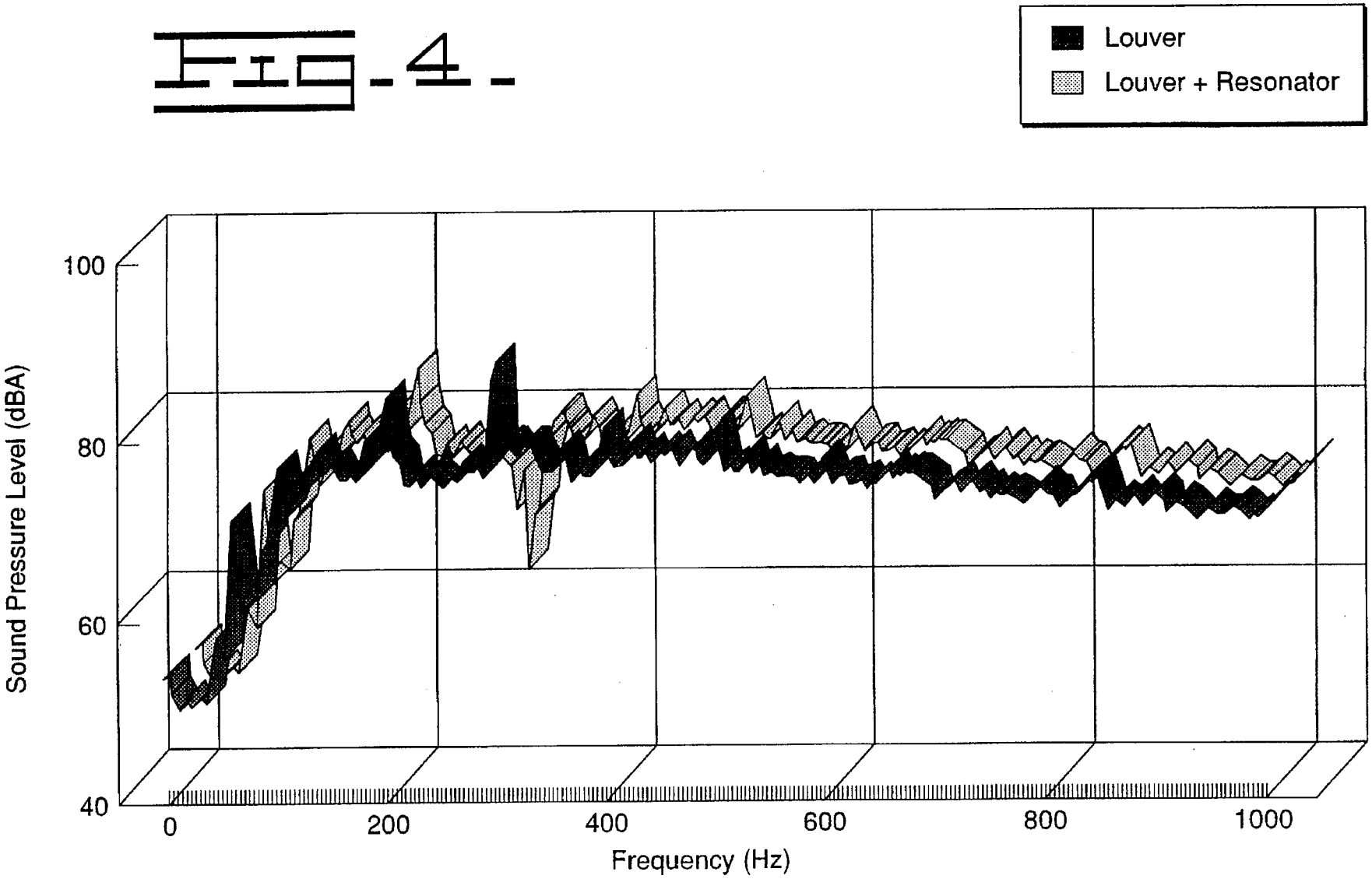
FIG. 4 is graphical comparison of the sound pressure level in dB's for a power system utilizing a standard louver panel attenuator and one utilizing Applicant's present invention.

The result of the foregoing is best understood by considering the exemplary sound pressure level traces as set forth in FIG. 4. This exemplary figure shows a comparison of the sound level trace from a typical power system enclosure utilizing a standard louver attenuator and utilizing an attenuator as disclosed in the first embodiment. The dominant noise source in this representation is the sound from the internal combustion engine at a frequency corresponding to its firing sequence. As can be seen the spike at the engine operating frequency has been reduced by approximately 18 dBs thereby reducing the overall noise signature by 3 dBs. If additional resonator banks were added in series with this attenuator, additional noise peaks could be attenuated, thereby further reducing the overall noise signature from the enclosure.

While the present invention is specifically directed at reducing the noise signature from an internal combustion engine operating within a power generating system, the present invention has many other application. The present invention could be utilized for any installation having a sound source with dominant noise spikes at a few discrete low frequencies and a lower level of broadband noise and limitations precluding the use of standard sound attenuators, such as limited space, excessive pressure loss, or the flexibility to attenuate noise from various sound sources having different dominant peak frequencies.

Other aspects, objects, advantages of this uses can be obtained from a study of the drawings, the disclosure, and the appended claims.

What is claimed is:

1. An apparatus for attenuating sound from an enclosure, comprising:

a frame, said frame being adapted for mounting in a wall, said frame having inner and outer surfaces;

a plurality of sound absorptive panels positioned in said frame and being substantially parallel and spaced apart from one another;

a plurality of resonator units, each said resonator unit having a preselected volume and an opening of a preselected diameter, a selected number of said resonator units interconnected to form a plurality of first resonator rows;

each said first resonator row extending across said frame and being spaced apart from one another and positioned between said sound absorptive panels, said first resonator rows being fixedly positioned to said frame such that each said opening is arranged in a direction substantially parallel to the flow direction of air in and out of said enclosure.

2. The sound attenuation apparatus of claim 1, wherein the enclosure has an outer surface, and said frame is positioned flush with said outer surface.

3. The sound attenuation apparatus of claim 1, wherein the first resonator rows define a duct substantially parallel to the flow direction of air in and out of said enclosure and said opening communicates said volume with said duct.

4. The sound attenuation apparatus of claim 1, wherein the enclosure includes a wall and wherein said panels are straight louvers of sound absorptive material.

5. The sound attenuation apparatus of claim 1, wherein the enclosure includes a wall and wherein the panels are V-shaped louvers made of sound absorptive material.

6. The sound attenuation apparatus of claim 1, wherein the panels are straight slats of sound absorptive material positioned parallel to the flow direction of air in and out of said enclosure.

7. The sound attenuation apparatus of claim 1, wherein each said resonator unit defines an inner volume, said volume sized to attenuate a distinct sound frequency.

8. The sound attenuation apparatus of B claim 1, wherein said resonator unit opening has a diameter sized to attenuate a distinct sound frequency.

9. The sound attenuation apparatus of claim 1, further including a plurality of second resonator units, each said second resonator unit having a second preselected volume and a second opening of a second preselected diameter, a selected number of said second resonator units interconnected to form a plurality of second resonator rows;

each said second resonator row extending across said frame and being spaced apart from one another, said second resonator rows being fixedly mounted to said first resonator rows such that each said second opening is arranged in a direction substantially parallel to the flow direction of air in and out of said enclosure.

10. The sound attenuation apparatus of claim 9, wherein said second resonator unit defines a second inner volume, said second inner volume sized to attenuate a second distinct sound frequency.

11. The sound attenuation apparatus of claim 9, wherein said second opening has a diameter sized to attenuate a second distinct sound frequency.

12. The sound attenuation apparatus of claim 9, wherein said top and bottom surfaces of said first and second resonator rows are substantially flush and thereby form a duct between said first and second resonator rows substantially parallel to the flow direction of air in and out of said enclosure.

13. The sound attenuation apparatus of claim 1, wherein said sound absorptive panels define a louver open area therebetween, each said louver open area having a resonator row positioned therein.

14. The sound attenuation apparatus of claim 1, wherein said first resonator rows define a resonator bank, said apparatus including a plurality of resonator banks, each said resonator bank fixedly mounted in series with the first resonator bank such that each said opening is arranged in a direction substantially parallel to the flow direction of air in and out of said enclosure.

15. An apparatus for attenuating noise from a power system enclosure, comprising:

an enclosure wall having inner and outer surfaces, said wall having an opening extending therethrough;

a plurality of sound absorptive slats positioned in said wall opening and being substantially parallel and spaced apart from one another, said slats defining a panel, said panel having an inner and an outer surface;

a plurality of resonator units, each said resonator unit having a preselected volume and an opening of a preselected diameter, a selected number of said resonator units interconnected to form a plurality of first resonator rows;

each said first resonator row extending across said wall opening and being positioned between said slats, defining an open area therebetween, said resonator rows being fixedly positioned to said panel inner surface such that each said opening is substantially perpendicular to said enclosure wall.

16. The sound attenuation apparatus of claim 15, wherein said opening defines an air inlet for the intake of cooling and combustion air.

17. The sound attenuation apparatus of claim 15, wherein said opening defines an air discharge for exhausting room ambient air.

18. The sound attenuation apparatus of claim 15, wherein each said resonator unit defines an inner volume, said volume sized to attenuate the noise source dominant noise frequency.

19. The sound attenuation apparatus of claim 15, wherein said resonator unit opening is sized to attenuate the noise source dominant noise frequency.

20. The sound attenuation apparatus of claim 15, wherein said slats are straight louvers of sound absorptive material.

21. The sound attenuation apparatus of claim 15, wherein the slats are V-shaped louvers made of sound absorptive material.

22. The sound attenuation apparatus of claim 15, wherein the slats are straight pieces of sound absorptive material positioned parallel to the direction of flow in and out of said enclosure.

* * * * *